US005894799A

United States Patent [19]

Bart et al.

[11] Patent Number: 5,894,799

[45] Date of Patent: Apr. 20, 1999

[54] ELEMENT FOR CUSHIONING A FLEXOGRAPHIC PRINTING PLATE

[75] Inventors: Anthony John Bart, Cherry Hill, N.J.; Jeffrey Albert Randazzo, 4790 NW. 106th Ave., Coral Springs, Fla. 33076

[73] Assignees: E. I. du Pont de Nemours and Company, Wilmington, Del.; Jeffrey Albert Randazzo, Delray Beach, Fla.

[21] Appl. No.: 08/942,114

[22] Filed: Oct. 1, 1997

[51] Int. Cl.[6] ..... B41F 13/10

[52] U.S. Cl. ..... 101/376; 101/379

[58] Field of Search ..... 101/376, 379, 101/382.1, 395, 401.1; 428/304.4, 909

[56] References Cited

U.S. PATENT DOCUMENTS

| | | | |
|---|---|---|---|
| 3,147,698 | 9/1964 | Ross | 428/304.4 |
| 3,285,799 | 11/1966 | Peterson | 161/93 |
| 3,470,059 | 9/1969 | Jonnes | 101/401.1 |
| 3,663,289 | 5/1972 | Newman | 101/401.1 |
| 4,025,685 | 5/1977 | Haren et al. | 101/401.1 |
| 4,093,764 | 6/1978 | Duckett et al. | 428/909 |
| 4,234,640 | 11/1980 | Wittel | 101/395 |
| 4,547,453 | 10/1985 | Worns et al. | 430/271 |
| 4,582,777 | 4/1986 | Fischer et al. | 430/271 |
| 4,684,600 | 8/1987 | Worns et al. | 430/271 |
| 5,034,268 | 7/1991 | Sekidou et al. | 428/909 |
| 5,325,776 | 7/1994 | Rather, Sr. et al. | 101/382.1 |
| 5,352,507 | 10/1994 | Bresson et al. | 428/245 |
| 5,476,712 | 12/1995 | Hartman et al. | 428/317.3 |
| 5,478,637 | 12/1995 | Tomono et al. | 428/246 |
| 5,549,968 | 8/1996 | Byers et al. | 428/241 |
| 5,644,985 | 7/1997 | Serain et al. | 101/415.1 |

*Primary Examiner*—Edgar Burr
*Assistant Examiner*—Amanda B. Sandusky
*Attorney, Agent, or Firm*—Thomas H. Magee

[57] ABSTRACT

A cushioning or damping layer is disposed between a flexographic printing plate and a printing cylinder or sleeve. The cushion layer is composed of an elastomeric material which has an open-cell relief surface which is sufficiently compressible to compensate for variations in printing materials and press conditions used during printing.

12 Claims, 1 Drawing Sheet

ELEMENT FOR CUSHIONING A FLEXOGRAPHIC PRINTING PLATE

BACKGROUND OF THE INVENTION

1. Field of the Invention

This invention relates to a cushion element for use between a flexographic printing plate and a printing cylinder during printing.

2. Description of Related Art

Flexography applies broadly to printing processes utilizing flexible substrates bearing elastomeric or rubbery relief printing surfaces. Flexographic printing plates are well known for use in printing, particularly on surfaces which are soft and easily deformable, such as packaging materials, e.g., cardboard, plastic films, etc. Flexographic printing plates can be prepared from photosensitive elements containing photopolymerizable compositions, such as those described in U.S. Pat. Nos. 4,323,637 and 4,427,749. The photopolymerizable compositions generally comprise an elastomeric binder, at least one monomer and a photoinitiator. The photosensitive elements generally have a photopolymerizable layer interposed between a support and a coversheet or multilayer cover element. Upon imagewise exposure to actinic radiation, the photopolymerizable layer polymerizes in the exposed areas causing insolubilization of the exposed photopolymerizable composition. Treatment with a suitable solvent removes the unexposed areas of the photopolymerizable layer leaving a printing relief which can be used for flexographic printing.

Historically, to mount flexographic plates to a printing cylinder, vinyl sheets having adhesive coated on each side, commonly referred to as stickyback, have been used. Plates are mounted with a partial or entire layer of stickyback between the plate and the printing cylinder. The vinyl sheets are incompressible, thin and tend to vary in caliper. The plate, printing cylinder, gears, substrate and impression cylinder also each have variations in tolerances in surface smoothness and height or thickness. Such inaccuracies dictate the use of increased pressure in the printing process, but such increased pressure causes a deterioration in print quality due to yielding under pressure of the flexographic printing plates. Undesirable results include a dirty appearance of printing and inaccurate reproduction of half tones, e.g., oval dots or halos around characters and images. In addition, there is an increase in the use of thinner plates formed by photopolymerization techniques which can accentuate the resulting problems associated with printing with non-uniform materials such as, plates, cylinders, gears and substrates.

In an effort to overcome the shortcomings of the stickyback sheet, layers of synthetic polymeric foam as backing materials or as tapes are used in mounting the flexographic plate on the printing cylinder. The polymeric foam materials are compressible and thus have sufficient cushioning effect to compensate for the variations in thickness or surface height of the plate, plate cylinder, gears, substrate and impression cylinder. In addition, the foam materials must have sufficient resiliency to rebound rapidly and repeatedly to the original dimensions during printing. However, polymeric foam materials typically fatigue with use during printing since the foam looses compressibility and resiliency, and cannot rebound to its original dimensions.

U.S. Pat. No. 3,285,799 discloses a printing blanket for long periods of use in offset lithography which is composed of a polymeric film and woven backing, an ink transfer layer, and a resilient compressible support layer. The support layer has an external surface subdivided by grooves which leaves flat surfaced islands. The blanket is used as an intermediate to transfer an ink image from a printing plate to paper. The support layer has a durometer of at least 60 Shore A. The support layer contains at least about 0.005 cubic inches of voids per square inch of blanket surface but total void volume does not exceed 40%.

U.S. Pat. No. 5,325,776 discloses a cushioning backing sheet material positioned between a flexographic printing cylinder and a flexible printing plate. The cushioning sheet is an elastomeric material containing widely spaced closed-cell voids which provide pockets within which the encapsulated air can be pneumatically compressed when force is applied, and which will rebound rapidly when the force is relieved. A disadvantage of the closed-cell cushioning material is that the cells break with successive use such that the cushioning material fatigues and looses compression and resilience qualities, and thus print quality deteriorates.

SUMMARY OF THE INVENTION

It is an object of the invention to provide an element for cushioning a flexographic printing plate on a printing cylinder which compensates for variations in thickness and height of the materials and equipment used during printing without increasing printing pressure so that the resulting printing is high quality, and which rebounds rapidly to substantially the original thickness so that high quality prints can be made repeatedly, particularly over extended printing runs.

It is another object of the invention to provide an element which simulates the properties of compressible foam backing and tape materials, but which does not fatigue and loose compressibility with time in use.

In accordance with this invention there is provided an element for cushioning a flexographic printing plate mounted on a printing cylinder during printing. The element comprises a cushion layer of an elastomeric material having a relief surface of open-cells having a total void volume in excess of 40 percent.

DESCRIPTION OF THE PREFERRED EMBODIMENT(S)

Figure 1:
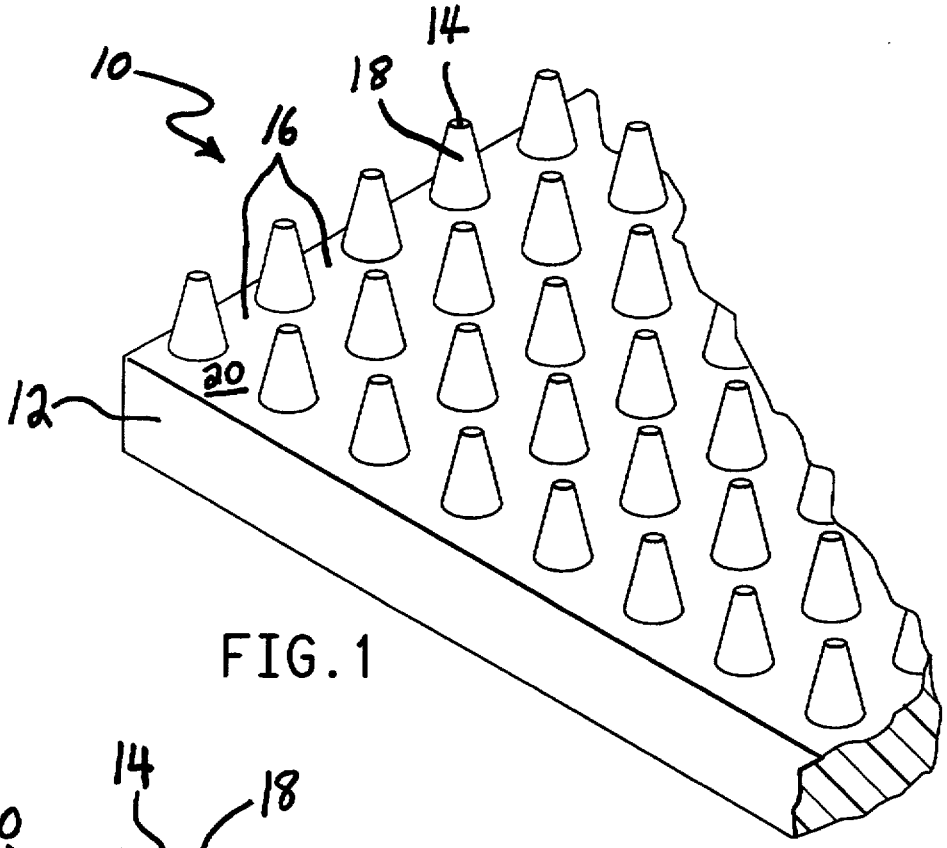
FIG. 1 is a partial perspective view of an element for cushioning a flexographic plate in accordance with the present invention.

A cushion element is utilized as a cushioning or damping layer between a flexographic printing plate and a plate support such as a printing cylinder or sleeve. The cushion element may be part of the cylinder or sleeve, or may be completely separate therefrom. The cushion element comprises an elastomeric material which has an open-cell relief surface. When used with a flexographic printing plate, the cushion element is sufficiently compressible to compensate for variations in thickness or surface height of the plate, plate cylinder, gears, substrate and impression cylinder during printing. In addition, the cushion element is sufficiently resilient to rebound rapidly and repeatedly from the compressed state to the original dimensions during printing with no or only minimal fatigue over time.

The cushion element comprises a cushion layer made of an elastomeric material. Elastomeric materials are those which at room temperature can be deformed under low stress and will return to its original dimension/s upon removal of the stress. Any elastomeric material is suitable for use as the cushion element providing a relief of open-cells can be formed in the material. Elastomeric materials include vulcanized rubbers, both natural and synthetic, as well as modified high polymers. Suitable elastomeric materials include, but are not limited to, polybutadiene; polyisoprene; polychloroprene; and olefin copolymers such as styrene-butadiene copolymers, nitrile rubbers (e.g., acrylonitrile-butadiene copolymer), ethylene-propylene copolymers, and butyl rubber (e.g., isobutylene-isoprene copolymer). Elastomers which are thermoplastic are also suitable as the cushion layer and include, but are not limited to, styrene-diene-styrene triblock copolymers, such as polystyrene-polybutadiene-polystyrene (SBS), polystyrene-polyisoprene-polystyrene (SIS), or polystyrene-poly (ethylenebutylene)-polystyrene (SEBS); thermoplastic polyester and polyurethane elastomers; and thermoplastic polyolefin rubbers (polyolefin blends). Suitable elastomers also include chlorosulfonated polyethylene, polysulfide, polyalkylene oxides, polyphosphazenes, elastomeric polymers and copolymers of acrylates and methacrylates, and elastomeric copolymers of vinyl acetate and its partially hydrogenated derivatives.

The cushion element can include more than one layer of elastomeric material provided that the layers function for the intended purpose. The cushion element can also include a support for the elastomeric layer. The support can be made of any metallic or polymeric film material which is dimensionally stable. Typically, the support will have an adhesion promoting surface or a layer of adhesive to assure that the elastomeric layer adheres to the support. The adhesive layer on the exterior surface of the support can be a subbing layer of an adhesive material or primer or an anchor layer as disclosed in U.S. Pat. No. 2,760,863 to give strong adherence between the support and the elastomeric layer. In addition, the support can be treated with flame-treatment or electron-treatment to promote adhesion between the support and the elastomeric layer.

The layer of elastomeric material used as the cushion layer may have a durometer of up to 65 Shore A, and preferably at least about 40 Shore A. The cushion layer can be any thickness which can provide a relief of open-cells suitable for displacing under printing pressure. Other factors which may influence the choice of thickness for the cushion layer is the desired cushioning effect and resilience, as well as printing conditions, such as, for example, pitch height. Generally a cushion layer of up to 285 mils (0.04 to 0.72 cm) in thickness is suitable, and preferably from 45 to 107 mils (0.11 to 0.27 cm) in thickness. The cushion layer should be able to accommodate impressions of from 0.5 to 10 mils (0.0013 to 0.0254 cm) during printing.

One side of the cushion layer includes a relief surface having a plurality of open-cells. The plurality of open-cells can be a random pattern or a uniform pattern, preferably a uniform pattern of open-cells. It is preferred that the plurality of open-cells cover or substantially cover the surface of the layer to provide suitable cushioning support for the printing plate during printing. Less than the entire surface of the cushion layer can have open-cells, but the open-cells must be in areas which at least will correspond to the printing areas of a printing plate. The open-cells in the cushion layer provide the element with the ability to compress during printing with no or only minimal loss of compressibility for extended periods of time. The elastomeric material forming the cushion layer provides the element with the resilience to continue to rebound from compressed state to its original dimensions during printing, with no or minimal permanent deformation for extended periods of time.

Figure 2:
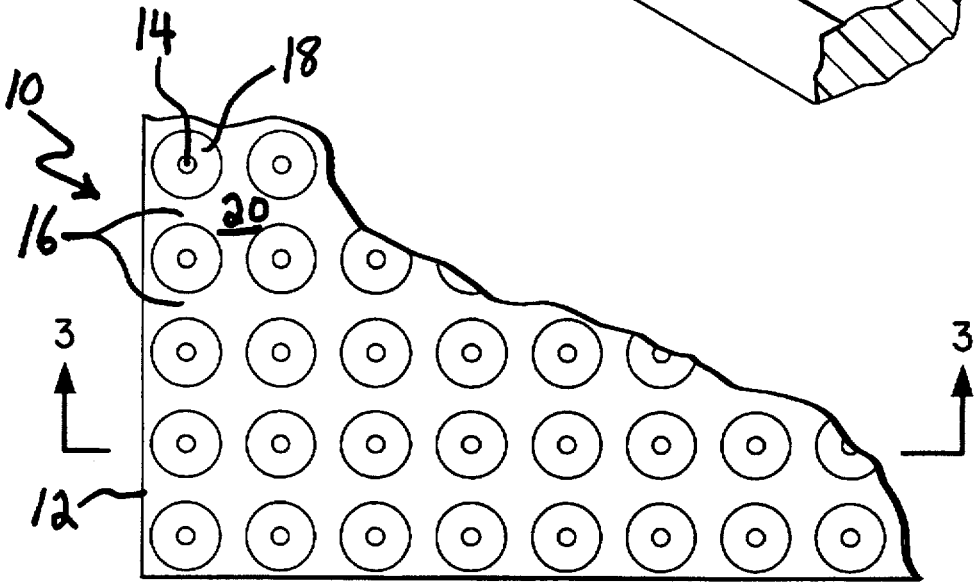
FIG. 2 is a plan view of the cushioning element shown in FIG. 1.
Figure 3:
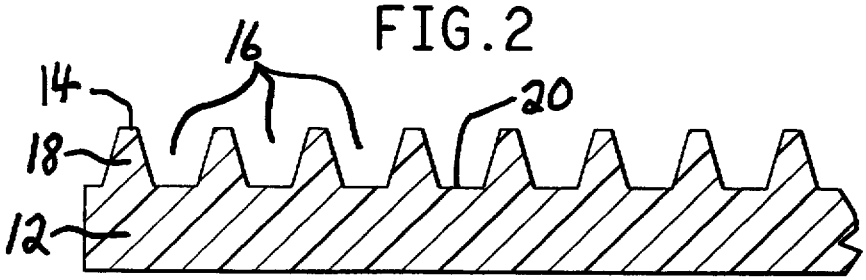
FIG. 3 is a cross-sectional view taken along line 3—3 of FIG. 2.

Each open-cell of the plurality of open-cells can be considered as a volume of elastomeric material from which some portion of the material has been removed to form a relief from the surface of the layer. Each of the cells are open in that the void created from the removed material can be observed from the surface of the cushion layer, that is, there are no voids completely interior to the layer. An open-cell can be described in terms of an area of material removed to a relief depth, or most preferably, the open-cell is described in terms of a percent void volume. Percent void volume is the percentage of elastomeric material removed per cell (that is, per unit of volume of the cushion layer). The open-cells in the cushion layer have a total void volume in excess of 40 percent, preferably at least 80 percent, and most preferably 90 to 98 percent void volume. Thus, less than 60 percent of the elastomeric material remains in the open-cells when the open-cells have a void volume in excess of 40 percent. As the percent void volume increases above 40 percent void volume, and particularly at void volumes greater than 80 percent, the open-cell in the cushion layer appears as a pencil-like member or finger protruding from a floor of the layer. There is no limitation to the number of open-cells in a given area of the cushion layer provided that the open-cells in the area have a total void volume in excess of 40 percent, and that the layer is able to adequately cushion a printing plate. A small number of open-cells in the layer may not be sufficient to cushion a flexographic printing plate. Since it is preferred that there is a large number of open-cells in the cushion layer, the open-cells in the cushion layer appear as a plurality of pencil-like members or fingers protruding from the floor of the layer, resembling a bed of nails. FIGS. 1 through 3 illustrate the above-described element 10 for cushioning a flexographic printing plate. The element 10 comprises a cushion layer 12 of an elastomeric material having a relief surface 14 of open-cells 16 having a total void volume in excess of 40 percent. The open-cells 16 are formed by a plurality of pencil-like members 18 or fingers protruding from a floor 20 of the cushion layer 12.

The open-cells can have a relief depth of 3 to 50 mils (0.0076 to 0.127 cm), preferably 3 to 30 mils (0.0076 to 0.076 cm), and most preferably 20 mils (0.050 cm).

The plurality of open-cells comprise a relief pattern which can be formed in the cushion layer in any manner consistent to produce the desired pattern, such as, for example, photomechanically by using a photosensitive elastomeric material; mechanically, for example by cutting the material with a knife or by laser engraving as disclosed by Cushner et al. in WO 93/23252 and WO 93/23253, and by McCaughey, Jr. in U.S. Pat. No. 5,259,311; casting from a mold; and embossing. Preferably, the cushion layer is made from a photosensitive elastomeric element, particularly a photopolymerizable printing element in which the relief pattern is formed in the layer with a mask film as disclosed, for example, by Chen in U.S. Pat. No. 4,369,246 and U.S. Pat. No. 4,323,636 and by Gruetzmacher et al. in U.S. Pat. No. 4,427,759. The relief pattern also can be formed in a photopolymerizable element with a mask image which is digitally available with the use of laser radiation. A photopolymerizable element which has an infrared-sensitive layer thereon can be imagewise ablated with infrared-sensitive radiation to form the mask in-situ on the element as disclosed by Fan in U.S. Pat. No. 5,262,275 and by Van Zoeren in U.S. Pat. No. 5,056,086.

In the preferred embodiment, the cushion layer is made from a photopolymerizable printing element comprising a layer of photopolymerizable material. Photopolymerizable materials are well known and encompass systems which are photopolymerizable, photocrosslinkable, or both. The photopolymerizable layer comprises an elastomeric binder, at least one monomer and an initiator, where the initiator is preferably a photoinitiator having sensitivity to actinic radiation. In most cases, the initiator will be sensitive to visible or ultraviolet radiation. Any photopolymerizable compositions which are suitable for the formation of flexographic printing plates can be used for the present invention. Examples of suitable compositions have been disclosed, for example, in Chen et al., U.S. Pat. No. 4,323,637, Grüetzmacher et al., U.S. Pat. No. 4,427,749 and Feinberg et al., U.S. Pat. No. 4,894,315.

The elastomeric binder can be a single polymer or mixture of polymers which can be soluble, swellable or dispersible in aqueous, semi-aqueous or organic solvent developers. Binders which are soluble or dispersible in aqueous or semi-aqueous developers have been disclosed in Alles, U.S. Pat. No. 3,458,311; Pohl, U.S. Pat. No. 4,442,302; Pine, U.S. Pat. No. 4,361,640; Inoue et al., U.S. Pat. No. 3,794,494; Proskow, U.S. Pat. No. 4,177,074; Proskow, U.S. Pat. No. 4,431,723; and Worns, U.S. Pat. No. 4,517,279. Binders which are soluble, swellable or dispersible in organic solvent developers include natural or synthetic polymers of conjugated diolefin hydrocarbons, including polyisoprene, 1,2-polybutadiene, 1,4-polybutadiene, butadiene/acrylonitrile, butadiene/styrene thermoplastic-elastomeric block copolymers and other copolymers. The block copolymers discussed in Chen, U.S. Pat. No. 4,323,636; Heinz et al., U.S. Pat. No. 4,430,417; and Toda et al., U.S. Pat. No. 4,045,231 can be used. It is preferred that the binder be present in at least an amount of 65% by weight of the photopolymerizable layer. The term binder, as used herein, encompasses core shell microgels and blends of microgels and preformed macromolecular polymers, such as those disclosed in Fryd et al., U.S. Pat. No. 4,956,252.

The photopolymerizable layer can contain a single monomer or mixture of monomers which must be compatible with the binder to the extent that a clear, non-cloudy photosensitive layer is produced. Monomers that can be used in the photopolymerizable layer are well known in the art and include but are not limited to addition-polymerization ethylenically unsaturated compounds having relatively low molecular weights (generally less than about 30,000), preferably molecular weights less than about 5000. Examples of monomers can be found in Chen, U.S. Pat. No. 4,323,636; Fryd et al., U.S. Pat. No. 4,753,865; Fryd et al., U.S. Pat. No. 4,726,877 and Feinberg et al., U.S. Pat. No. 4,894,315. It is preferred that the monomer be present in at least an amount of 5% by weight of the photopolymerizable layer.

The photoinitiator can be any single compound or combination of compounds which is sensitive to actinic radiation, generating free radicals which initiate the polymerization of the monomer or monomers without excessive termination. The photoinitiator is generally sensitive to actinic light, e.g., visible or ultraviolet radiation, preferably ultraviolet radiation. Preferably, the photoinitiator should be thermally inactive at and below 185° C. Examples of suitable photoinitiators include the substituted and unsubstituted polynuclear quinones. Examples of suitable systems have been disclosed in Grüetzmacher, U.S. Pat. No. 4,460,675 and Feinberg et al., U.S. Pat. No. 4,894,315. Photoinitiators are generally present in amounts from 0.001% to 10.0% based on the weight of the photopolymerizable composition.

The photopolymerizable layer can contain other additives depending on the final properties desired. Such additives include sensitizers, plasticizers, rheology modifiers, thermal polymerization inhibitors, tackifiers, colorants, antioxidants, antiozonants, or fillers.

The cushion element can include a support of at least one polymeric film. The support can be made of any polymeric material which is dimensionally stable and which is non-reactive so as to remain stable throughout processing. Preferably, the support is transparent or substantially transparent to actinic light. Actinic light includes visible and ultraviolet radiation. Examples of suitable polymeric materials include polymeric films, such those formed by addition polymers and linear condensation polymers. Linear polyesters are preferred, particularly polyethylene terephthalate (PET). The support can have a thickness from 0.010 to about 2 inches (0.025 to 5.08 cm), preferably from 10 to 100 mils (0.025 to 0.25 cm). Generally, a preferred thickness is dependent upon the desired end-use conditions.

The relief pattern of open-cells is formed in the elastomeric layer of the photopolymerizable element by exposure to actinic radiation through a mask and washout of the non-exposed areas. The type of radiation used is dependent on the type of photoinitiator in the photopolymerizable layer. Any conventional source of actinic radiation can be used for this exposure step. Any source of actinic radiation, e.g., visible or UV radiation, can be used. The most suitable sources of UV radiation are the mercury-vapor lamps, particularly sun lamps. A standard radiation source is the Sylvania 350 Blacklight fluorescent lamp (FR 48T12/350 VL/VHO/180,115w) which has a central wavelength of emission around 354 nm. The actinic radiation exposure time can vary from a few seconds to minutes, depending upon the intensity and spectral energy distribution of the radiation, its distance from the photopolymerizable layer, and the nature and amount of the photopolymerizable layer.

The process of forming the relief pattern also can include a back exposure or backflash step which is a blanket exposure to actinic radiation through the support (or the side of the photopolymerizable layer without relief). Such a blanket exposure is used to create a shallow layer of polymerized material, or a floor, on the support side of the layer and to sensitize the photopolymerizable layer. The floor generally establishes the depth of the relief. The backflash exposure can take place before, after or during the other imaging steps. Conventional radiation sources can be used for the backflash exposure step and can range from a few seconds up to about a minute.

The mask used to form the plurality of open-cells may be a halftone screen, i.e., a film having a dot structure of equal size dots and equal density. Screens are described in terms of dot size and screen ruling of the dots, that is, the number of lines of dots per inch (line density). Since conventionally a screen has a repeatable overall pattern of dots of a particular density, the use of a screen simplifies generating the plurality of open-cells. The dots can have any shape including square, elliptical, and preferably round. The screen ruling can be up to 350 lines (of dots) per inch (lpi) with dot sizes ranging from 2–3 to 60 percent dot in order to create the desired open-cell relief pattern in the photopolymerizable layer. It is preferred that the screen has a courser line density on the order of less than 100 lpi and less than 30 percent dot. Most preferably the screen has a line density of 40 lpi and a 2% dot. It is also possible to use a screen having combinations of different size dots, or a pattern other than dots. Void volume is the reciprocal of the dot size, that is, for example, a 20 percent dot will provide 80 percent void volume of an open-cell. The line density influences the number of open-cells in a given area that accounts for the total void volume. The higher the line density, the greater the number of open-cells that, in total, produce the designated total void volume.

Following exposure, the pattern is developed by washing the cushion element with a suitable developer. Development is usually carried out at about room temperature. The developers can be organic solvents, aqueous or semi-aqueous solutions, and water. The choice of the developer will depend primarily on the chemical nature of the photopolymerizable material to be removed. Suitable organic solvent developers include aromatic or aliphatic hydrocarbon and aliphatic or aromatic halohydrocarbon solvents, or mixtures of such solvents with suitable alcohols. Suitable semi-aqueous developers usually contain water and a water miscible organic solvent and an alkaline material. Suitable aqueous developers usually contain water and an alkaline material. Development time may vary, but it is preferably in the range of about 2 to 25 minutes. Developer can be applied in any convenient manner, including immersion, spraying and brush or roller application. Brushing aids can be used to remove the unpolymerized portions of the layer. However, washout is frequently carried out in an automatic processing unit which utilizes developer and mechanical brushing action to remove the unexposed portions of the layer.

Following development, the cushion element containing the relief pattern is typically blotted or wiped dry, and then dried in a forced air or infrared oven at a suitable time and temperature. The element can also be uniformly post-exposed to ensure that the photopolymerization or photocrosslinking process is complete and that the element will remain stable during printing and storage. The post-exposure step utilizes the same radiation source as the main exposure. Detackification is an optional post-development treatment which can be applied if the surface of the element is still tacky. Preferably, detackification is accomplished by exposure to radiation sources having a wavelength not longer than 300 nm.

Alternatively, the elastmeric layer can be engraved with laser radiation to form the relief pattern of open-cells. Suitable methods of laser engraving elastomeric layers are disclosed by Cushner et al. in WO 93/23252 and WO 93/23253, and by McCaughey, Jr. in U.S. Pat. No. 5,259,311, which are hereby incorporated by reference. In these examples, the elastomeric layer is reinforced prior to laser engraving. Reinforcement of the elastomeric layer can be accomplished by thermochemical, photochemical, or mechanical means, or combinations thereof. Thus, the elastomeric material can also include components suitable to reinforce the layer, i.e., reinforcing agents, for the purpose of laser engraving. Thermochemical reinforcement is accomplished by incorporating materials, which undergo hardening reactions when exposed to heat, into the elastomer. Photochemical reinforcement is accomplished by incorporating photohardenable materials into the elastomeric layer and exposing the layer to actinic radiation, as is described above. Mechanical reinforcement can be accomplished by incorporating materials called reinforcing agents into the elastomeric material. Examples of reinforcing agents include, but are not limited to, particulate materials, such as, carbon black, silica, $TiO_2$, calcium carbonate, and calcium silicate, graphite, mica, aluminum and alumina.

Laser engraving involves the absorption of laser radiation, localized heating and removal of material in three dimensions. The same or similar surface patterns of open-cells that are created by the screen mask can be produced by engraving of elastomeric material with the use of laser radiation. As is known to those skilled in the art, the mask image in any form can be converted into digital information and electronically stored on a computer prior to laser engraving. The digital information is used to modulate the laser during the engraving process. The laser impinges the elastomeric material to be engraved at or near its focus spot. Factors to be considered when laser engraving include, but are not limited to, deposition of energy into the depth of the element, thermal dissipation, melting, vaporization, thermally induced chemical reactions such as oxidation, airborne material over the surface of the element being engraved, and mechanical ejection of material from the element being engraved, i.e., debris removal.

Engraving of elastomeric materials is a thermally induced process in which the energy of a focused beam of laser radiation is absorbed by the material. The laser output must be at a wavelength which is strongly absorbed by the material to be engraved. The elastomeric material itself may be capable of absorbing the laser radiation, or the elastomeric material may include at least one laser radiation absorbing component to increase the absorptivity of the material. Laser radiation absorbing components include infrared absorbing dyes and pigments, which are particularly suited for use with an infrared-emitting solid state laser. Carbon black is a preferred pigment which can act as both a laser radiation absorbing component as well as a reinforcing agent for mechanically reinforced elastomeric layers. Generally, elastomers themselves are capable of absorbing radiation around ten (10) micrometers and, thus, do not require an additional laser radiation absorbing component in order to engrave with a laser operating at this wavelength, such as a carbon dioxide laser. In contrast, elastomers are generally not capable of absorbing radiation around one (1) micrometer and, thus, usually require a laser radiation absorbing component to absorb the light energy generated by an infrared-emitting solid state laser, such as a Nd:YAG laser, in order to be engraved. Lasers having wavelengths shorter than about 350 nm or longer than about 2 microns, are also suited for engraving elastomers. A range of energy density (fluence) suitable for laser engraving of the elastomeric layer is from 50 to 200 Joules/$cm^2$. A preferred laser write engine is a carbon dioxide laser operating at a wavelength of 10.6 microns which includes external drum with debris extraction to engrave photopolymeric elastomeric layers.

Some elastomeric materials, such as in particular natural or synthetic rubbers, may not need to be reinforced in order to laser engrave the open-cells.

The cushion element is disposed between a printing plate and a printing cylinder. The cushion layer can be placed relief side down (towards the printing cylinder) or relief side up (toward the printing plate) when mounted onto the printing cylinder, or both, when both top and bottom sides of one or more cushion layers contain relief surfaces. Optionally, a removable sleeve as is conventional in the art can be mounted onto the printing cylinder, and the cushion layer can be mounted to the sleeve. The cushion layer is mounted to the printing cylinder (or sleeve) using an adhesive. The adhesive can be an adhesive layer or usually a tape which typically is a vinyl sheet having adhesive on both sides, commonly called stickyback. The printing plate may be mounted to the cushion layer with a second layer of stickyback tape therebetween. The cushion element can be in any form suitable for cushioning a printing plate, including flat sheets and cylinders. The printing plate used in conjunction with the cushion element of the present invention preferably is a flexographic printing plate.

Advantages of the cushion layer of the present invention are many. The cushion layer has an extended life in terms of compressibility and resiliency in use as it can be used for long printing runs as well as reused as a cushioning layer for other printing runs. Another advantage is that the cushion layer can be handled separately from the printing plate, unlike compressible foam tapes which typically are destroyed when separated from the printing plate. An additional advantage is that the cushion layer compensates for the variations in thickness or surface of the plate, plate cylinder, substrate, gears and impression cylinder so that the printing pressure which is used can be set for optimum print quality.

EXAMPLES

Example 1 and Comparative Example

Example 1A

The following example demonstrates making a cushion layer from a photopolymerizable material containing an elastomeric binder and the influence of void volume in the cushion layer on printing.

A mask was made as is conventional in the art from a silver halide film type PFRM-7 (sold by DuPont, Wilmington, Del.) using a Barco Megasetter imagesetter, and processed in DRD developer (sold by DuPont). The mask from the film had multiple area segments, in which each segment had a particular screen line density (lines per inch) and a particular percent continuous tone dot size. The mask had an image of 6 segmented areas; (1) 350 lines per inch (lpi) and 50% dot, (2) 350 lpi and 20% dot, (3) 200 lpi and 50% dot, (4) 100 lpi and 80% dot, (5) 100 lpi and 50% dot, and (6) 100 lpi and 20% dot. All images were at a 52 degree screen angle which is relative to a longitudinal axis of the printing cylinder.

The cushion layer was made from a CYREL® 67HCS flexographic printing element (sold by DuPont). The coversheet of the element was removed and the mask was placed on the element. The element was exposed through the mask to actinic radiation at 365 nm in a UV light exposure unit by DuPont 2001 exposure unit and was processed in an inline photopolymer processor using OPTISOL® solvent washout solution, to washout unexposed areas of the element and form a relief pattern in the cushion layer. The cushion layer was dried in a forced air oven for 2 hours at 140° F. The cushion layer was aftertreated by exposing it to UV light for 10 minutes having peak radiation of 365 nm and 230 nm in order to insure complete polymerization and to render the cushion layer tack free. The cushion layer had a durometer of 50 Shore A. The cushion layer had 6 relief areas corresponding to the mask segments such that the relief area corresponding to mask segment (1) had a 50% void volume, (2) had a 80% void volume, (3) had a 50% void volume, (4) had a 20% void volume, (5) had a 50% void volume, and (6) had a 80% void volume.

A printing plate was made from a CYREL® flexographic printing element type EXL67, in which a relief image was formed by conventional method of imagewise exposure through a mask, washout and aftertreatment as explained above for the cushion layer. Hereto, the mask was made having six segments, but each segment was the same so that a pattern of the relief image in the plate repeated six times. Each segment contained grey scales of line screens of 65, 85, 120 and 150 lines per inch; fine type to bold type ranging from 2 point to 10 point; a large solid area; bar codes oriented in web direction and in cross-web direction based on the direction of printing; and a half-tone single color pictorial image.

The cushion layer was mounted with an adhesive tape onto a printing cylinder or a CYREL® sleeve which was mounted on the printing cylinder in order to achieve desired pitch height. The pitch height is the diameter of the gear that turns the printing cylinder. The sum of the diameter of all the elements i.e., adhesive layer/s, sleeve, cushion layer, printing plate, when mounted onto the print cylinder should equal the pitch height for optimum print quality. The adhesive tape is a layer of a 0.005 in. thick, vinyl, double-sided adhesive stickyback tape. The cushion layer was oriented on the cylinder with the side having the relief surface facing up (away from the printing cylinder). The flexographic printing plate was mounted on top of the cushion layer with the double-sided sticky back tape as a layer between the plate and the cushion layer, so that the relief image of the plate faced outward for printing. Each pattern of the relief image of the printing plate resided on one of the relief area segments in the cushion layer. Each relief image of the printing plate printed the same information but was cushioned differently due to the segments on the underlying cushion layer.

The printing cylinder with the cushion layer and the printing plate was mounted into a 60 in. wide flexographic printing press (made by W&H, Germany) having central impression and chambered doctor blade. An anilox (transfer) roll (from Praxair, Charlotte, N.C.) having a ceramic surface with 750 line screen, 1.45 billion cubic micron (bcm) volume and 5 micron cell depth was used. The ink was an alcohol-soluble polyimide resin process ink from Progressive Ink, (Lionville, Pa.), which was adjusted to 30 sec. viscosity on a #2 Zahn cup. The impression settings were at kiss, which is a printer's term to describe when the plate just touches the substrate with some ink skips, then at 0.002 in. to 0.006 in. increased impression setting. The substrate being printed was 0.001 in. thick opaque polyethylene film. The substrate was printed at press speeds of 600 feet per minute (fpm) and 100 fpm. The printing quality was evaluated.

As a comparative, a cushion layer was made of a CYREL® 67HCS flexographic printing element except that the element was overall exposed to actinic radiation (no imagewise exposure through a mask) to form a solid, i.e., having no relief, layer of elastomeric material. The element was processed to remove the release layer, dried and aftertreated, i.e., postexposed and lighttreated, as described above. The comparative solid cushion layer was mounted to a printing cylinder with the printing plate using double-sided sticky back tape as described above. Printing was conducted at the same conditions described above.

As a control, a flexographic printing plate was made as described above. The control printing plate was mounted onto a CYREL® sleeve 0.040 in. thick using a layer of compressible foam tape (type 1120 foam tape, 0.020 in. thick, made by 3M) having adhesive on both sides, between the sleeve and the printing plate. The foam tape is used conventionally for mounting of flexographic printing plates onto printing cylinders. No cushion layer of elastomeric material was used between the printing cylinder and the printing plate. Printing was conducted at the same conditions as described above.

The results were as follows:

For printing at 600 fpm:

| | Mask (screen lpi-dot size %) | Cushion Layer (% Void Volume) | Print Quality |
|---|---|---|---|
| Cushion segment 1 | 350–50 | 50 | C |
| Cushion segment 2 | 350–20 | 80 | C |
| Cushion segment 3 | 200–50 | 50 | C |
| Cushion segment 5 | 100–50 | 50 | B |
| Cushion segment 6 | 100–20 | 80 | B |
| Cushion segment 4 (comparative) | 100–80 | 20 | D |
| Comparative (solid cushion layer) | — | 0 | D |
| Control (compressible foam tape) | — | — | A |

The print quality was evaluated on a scale of "A" to "D" wherein "D" is poor, i.e., oval, slurred dots, and slurred halos on the solid and fine line images; "C" is marginally acceptable; "B" is acceptable and "A" is highly acceptable, i.e., sharp dots and clean edges on solid and fine line images and smooth ink lay for the solid areas.

Printing quality was the same for printing at 100 fpm as it was for 600 fpm. The usual printing differences were noted with changes in impression setting so that each test required optimized impression setting. For results where the print quality was poor, there was no impression setting which would improve print quality.

Printing using the comparative printing structure, i.e., solid elastomer as cushion layer underlying the printing plate, was poor as it produced oval, slurred dots and slurred halos around the solid and fine line images.

Printing using the control printing structure, i.e., foam tape between the printing plate and the cylinder, produced, as expected, sharp dots and clean edges on solid and fine line images. But the print quality for the control lacked smooth ink lay in the solid printed areas when optimized.

Printing using the cushion layer having an open-cell void volumes varied in quality ranging from marginally acceptable to highly acceptable, depending upon the void volume of the cushion layer. The quality of printing was directly related to the open-celled void volume relief in the cushion layer, which is the combination of line screen and dot size used in the mask to generate the relief. That is, high line per inch screens with large dot sizes produced marginal print results, e.g., slur and halo printing, and low line per inch screen with small dot sizes produced highly acceptable print results, all of which were improved over the solid cushion comparative.

Printing with the cushion layer generated from the 100 lpi screen and 20% dot, i.e., 80% void volume, produced print results nearly comparable to the control. The print quality varied according to the void volume and density of the segment. The cushion segment 6 having 80% void volume (and 100 lpi) had nearly similar print quality to that of the control.

Example 1B

Example 1A was repeated except that the mask used for the cushion layer was generated at a 7 degree screen angle (relative to the longitudinal axis of the printing cylinder) instead of the 52 degree screen angle. No appreciable difference in printing with a cushion layer made from this mask was observed.

Example 2

This example further demonstrates the influence of open-cell void volume in the cushion layer on printing.

Example 1A was repeated except that the mask used for the cushion layer was different. The mask had an image of 18 segments, in which the line density in the line screen was 31 lpi, 43 lpi, 62 lpi, 81 lpi, 99 lpi, and 115 lpi and continuous tone dot sizes were 20%, 10% and 5% for each line density, which corresponded to void volumes in the cushion layer of 80%, 90% and 95%, respectively.

| Sgmt. | Mask (screen lpi-dot size %) | Cushion Layer (% Void Volume) | Print Quality |
|---|---|---|---|
| 1 | 31–20 | 80 | A |
| 2 | 31–10 | 90 | A |
| 3 | 31–5 | 95 | A |
| 4 | 43–20 | 80 | A |
| 5 | 43–10 | 90 | A |
| 6 | 43–5 | 95 | A |
| 7 | 62–20 | 80 | A |
| 8 | 62–10 | 90 | A |
| 9 | 62–5 | 95 | A |
| 10 | 81–20 | 80 | A |
| 11 | 81–10 | 90 | A |
| 12 | 81–5 | 95 | A |
| 13 | 99–20 | 80 | A |
| 14 | 99–10 | 90 | A |
| 15 | 99–5 | 95 | A |
| 16 | 115–20 | 80 | A |
| 17 | 115–10 | 90 | A |
| 18 | 115–5 | 95 | A |

Additional printing images (grey scales) were used as plates to determine if moire would be an issue for the different line angles and line screens used for the colors associated with the flexographic printing process. Screens of 65, 85, 120, 150 lpi at angles of 37.5° magenta, 67.5° black, 97.5° cyan, and 82.5° yellow were tested to ensure that no moire pattern would occur due to pattern cushioning.

Example 3

This example demonstrates the effects of thickness, durometer, and relief heights of the cushion layer on the final print quality.

Example 3A

Example 1A was repeated except that the cushion layer was made from a CYREL® CL30 flexographic printing element (0.030 in. thick) and the mask was entirely (i.e., only 1 segment image) 90 lpi with a 20% continuous tone dot, which represented a void volume in the cushion layer of 80%. Also the image and back exposures were varied as is known in the art to attain a 23 mil relief depth of the open-cells. The cushion layer had a measured durometer of 65 Shore A.

Example 3B

Example 3A was repeated except that the cushion layer was made from a CYREL® PLS45 flexographic printing element which was 0.045 in. thick. Similarly the image and back exposures were varied such that one portion of the cushion layer had 30 mil relief depth and another portion of the layer had 15 mil relief depth. The mask was entirely (only one segment) 90 lpi with a 20% continuous tone dot, which represented a void volume in the cushion layer of 80%. The cushion layer had a durometer of 48 Shore A when used.

Example 3C

Example 3B was repeated except that three cushion layers were made all with the same thickness 0.067 in. but each having different durometer upon use. The cushion layers were all made from CYREL® flexographic printing elements; (1) type HOS67 having a durometer of 64 Shore A, (2) type HCS67 having a durometer of 50 Shore A, and (3) type TDR67 having a durometer of 38 Shore A. Each cushion layer had a portion at 30 mil relief depth and another portion at 15 mil relief depth by varying the image and back exposure times. The mask was entirely (only one segment) 90 lpi with a 20% continuous tone dot, which represented a void volume in the cushion layer of 80%.

Example 3D

Example 3C was repeated except that the three cushion layers all had the same thickness of 0.107 in., and each with a different durometer. The cushion layers were all made from CYREL® flexographic printing elements; (1) type HOS107 having a durometer of 64 Shore A, (2) type HCS107 having a durometer of 50 Shore A, and (3) type TDR107 having a durometer of 38 Shore A. Each cushion layer had relief depths of 30 mils and 15 mils and was exposed with a mask image of 90 lpi with a 20% continuous tone dot.

Example 3E

Example 1 was repeated except that the cushion layer was made from CYREL® flexographic printing element type HCS107 having a durometer of 50 Shore A. The mask had an image of 6 segments; (1) 90 lpi screen and 20% dot, (2) 90 lpi screen and 15% dot, (3) 90 lpi screen and 5% dot, (4) 40 lpi screen and 20% dot, (5) 40 lpi screen and 15% dot, (6) 40 lpi screen and 5% dot. All had a relief depth of 25 mils (0.025 in).

All Examples 3A through 3E were printed as described in Example 1 with 6 segments having the same image which corresponded with the segments in the cushion layer, printed at 100 and 600 fpm with impression setting adjusted for optimum print quality.

The results were:

| Exam. | Mask (screen lpi-dot size %) | Cushion Layer (% Void Volume) | Cushion Layer thickness (in.) | Relief Depth (mils) | Print Quality |
|---|---|---|---|---|---|
| 3A | 90–20 | 80 | 0.030 | 23 | C |
| 3B | 90–20 | 80 | 0.045 | 30 | B |
| | | | | 15 | B |
| 3C | 90–20 | 80 | 0.067 | (1) 30 | B |
| | | | | 15 | B |
| | | | | (2) 30 | A |
| | | | | 15 | A |
| | | | | (3) 30 | A |
| | | | | 15 | A |
| 3D | 90–20 | 80 | 0.107 | (1) 30 | A |
| | | | | 15 | A |
| | | | | (2) 30 | A |
| | | | | 15 | A |
| | | | | (3) 30 | A |
| | | | | 15 | A |
| 3E | 90–20 | 80 | 0.107 | 25 | A |
| | 90–15 | 85 | | | A |
| | 90–5 | 95 | | | A |
| | 40–20 | 80 | | | A |
| | 40–15 | 95 | | | A |
| | 40–5 | 95 | | | A |

Smaller dots and courser line screen provided improved results. The best results were attained with the 40 lpi screen having 5% dot which reproduced a 95% void volume. An appreciable difference in print quality with durometer changes (tested 64, 50 and 38) was not observed. However, there was a feeling by the press operators that there may be some advantages to work with cushion layers of soft durometer since this may provide wider impression latitude. There was no significant difference in print quality as a result of different relief depths. In general, cushion layers with thickness greater than 0.045 in. provided better print quality than thinner cushion layers.

What is claimed is:

1. An element for cushioning a flexographic printing plate mounted on a printing cylinder during printing comprising a cushion layer of an elastomeric material having a relief surface of open-cells having a total void volume in excess of 40 percent, said open-cells being formed by a plurality of pencil-like members or fingers protruding from a floor of the cushion layer.

2. The element of claim 1 in combination with a printing plate having a backside opposite a printing side, wherein the relief surface of the cushion layer faces the backside of the plate.

3. The element of claim 1 in combination with a printing cylinder, wherein the relief surface of the cushion layer faces the printing cylinder.

4. The element of claim 1 wherein the total void volume is greater than 50 percent.

5. The element of claim 1 wherein the total void volume is greater than 80 percent.

6. The element of claim 1 wherein the open-cells are of uniform size and shape.

7. The element of claim 1 wherein the open-cells are less than 100 lines per inch and have at least 70 percent void volume.

8. The element of claim 1 wherein the cushion layer is made from a photopolymerizable material comprising an elastomeric binder, at least one monomer and an initiator having a sensitivity to actinic radiation.

9. The element of claim 1 wherein the cushion layer is an elastomeric material selected from the group consisting of natural or synthetic polymers of conjugated diolefin hydrocarbons and thermoplastic-elastomeric block copolymers.

10. The element of claim 9 wherein the polymers are selected from the group consisting of polyisoprene, 1,2-polybutadiene, 1,4-polybutadiene, butadiene/acrylonitrile, butadiene/styrene, and block copolymers of styrene-butadiene-styrene and styrene-isoprene-styrene.

11. An element for cushioning a printing plate cylinder comprising in order:

a) a first adhesive layer on the printing cylinder;

b) a cushion layer on the first adhesive layer of an elastomeric material having an open-celled relief surface having a total void volume in excess of 40 percent, said open-cells being formed by a plurality of pencil-like members or fingers protruding from a floor of the cushion layer;

c) a second adhesive layer on the cushion layer for securing the printing plate to the cushion layer.

12. The element of claim 11 further comprising a cylindrical sleeve disposed between the first adhesive layer and the printing cylinder.

* * * * *